US010009704B1

(12) United States Patent
Allen

(10) Patent No.: US 10,009,704 B1
(45) Date of Patent: Jun. 26, 2018

(54) SYMMETRIC SPHERICAL HARMONIC HRTF RENDERING

(71) Applicant: GOOGLE INC., Mountain View, CA (US)

(72) Inventor: Andrew Allen, San Jose, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days. days.

(21) Appl. No.: 15/419,316

(22) Filed: Jan. 30, 2017

(51) Int. Cl.
*H04S 7/00* (2006.01)
*H04S 3/02* (2006.01)

(52) U.S. Cl.
CPC ..... *H04S 7/303* (2013.01); *H04S 3/02* (2013.01); *H04S 7/308* (2013.01); *H04S 2420/01* (2013.01); *H04S 2420/11* (2013.01)

(58) Field of Classification Search
None
See application file for complete search history.

(56) References Cited

U.S. PATENT DOCUMENTS

| | | | | |
|---|---|---|---|---|
| 6,766,028 | B1 | 7/2004 | Dickens | |
| 8,705,750 | B2 | 4/2014 | Berge | |
| 9,101,299 | B2 * | 8/2015 | Anderson | A61B 5/121 |
| 9,215,544 | B2 | 12/2015 | Faure et al. | |
| 9,332,360 | B2 * | 5/2016 | Edwards | H04R 25/43 |
| 9,420,393 | B2 | 8/2016 | Morrell et al. | |
| 9,584,934 | B2 * | 2/2017 | Kim | H04R 25/70 |
| 2008/0031462 | A1 | 2/2008 | Walsh et al. | |

(Continued)

OTHER PUBLICATIONS

Non Final Office Action for U.S. Appl. No. 15/290,717, dated Oct. 3, 2017, 11 pages.

(Continued)

*Primary Examiner* — Paul Huber
(74) *Attorney, Agent, or Firm* — Brake Hughes Bellermann LLP

(57) ABSTRACT

Techniques of performing binaural rendering involve separating symmetric and antisymmetric terms in the total output rendered in the ears of a listener. Along these lines, a sound field includes a set of sound field weights corresponding to spherical harmonic (SH) functions in a SH expansion of the sound field. In addition, an aggregate head-related transfer function (HRTF) includes a set of HRTF weights that correspond to a SH function. An HRTF weight may be generated from aggregating products of an HRTF at each of a set of loudspeaker positions and a SH function to which the HRTF weight corresponds at that loudspeaker position. The rendered sound field in one of the ears of the listener would be, when the sound field and HRTF is a function of frequency, a sum of the products of corresponding sound field weights and HRTF weights. One may save much computation by grouping the products into symmetric terms and antisymmetric terms. The rendered sound field in, say, the left ear is the sum over each loudspeaker position of the sum of the symmetric terms and antisymmetric terms for that loudspeaker position. Accordingly, because the head of the listener is assumed symmetric about the forward axis, the rendered sound field in the right ear is the sum over each loudspeaker position of the difference between the symmetric terms and antisymmetric terms for that loudspeaker position.

20 Claims, 4 Drawing Sheets

(56) References Cited

U.S. PATENT DOCUMENTS

| | | | | |
|---|---|---|---|---|
| 2009/0116657 | A1* | 5/2009 | Edwards | H04R 25/552 381/60 |
| 2013/0064375 | A1 | 3/2013 | Atkins et al. | |
| 2014/0355794 | A1 | 12/2014 | Sen et al. | |
| 2016/0029144 | A1 | 1/2016 | Cartwright et al. | |
| 2016/0219388 | A1 | 7/2016 | Oh et al. | |
| 2016/0241980 | A1 | 8/2016 | Najaf-Zadeh et al. | |
| 2017/0245082 | A1 | 8/2017 | Boland | |

OTHER PUBLICATIONS

"Definition of Transitive", Merriam-Webster Dictionary, printed Sep. 26, 2017, 1 page.

"Definition of Transitory", Merriam-Webster Dictionary, printed Sep. 26, 2017, 1 page.

Politis, Archontis, et al., "JSAmbisonics: A Web Audio library for interactive spatial sound processing on the web", ReaserchGate, Ambisonics Processing on the Web, Sep. 23, 2016, 9 pages.

Rafaely, Boaz, "Fundamentals of Spherical Array Processing", Spring Topics in Signal Processing, vol. 8, Chapter 1, 2015, 39 pages.

International Search Report and Written Opinion for International Application PCT/US2017/067642, dated Mar. 2, 2018, 13 pages.

* cited by examiner

SYMMETRIC SPHERICAL HARMONIC HRTF RENDERING

TECHNICAL FIELD

This description relates to binaural rendering of sound fields in virtual reality (VR) and similar environments.

BACKGROUND

Ambisonics is a full-sphere surround sound technique: in addition to the horizontal plane, it covers sound sources above and below the listener. Unlike other multichannel surround formats, its transmission channels do not carry speaker signals. Instead, they contain a speaker-independent representation of a sound field called B-format, which is then decoded to the listener's speaker setup. This extra step allows the producer to think in terms of source directions rather than loudspeaker positions, and offers the listener a considerable degree of flexibility as to the layout and number of speakers used for playback.

In ambisonics, an array of virtual loudspeakers surrounding a listener generates a sound field by decoding a sound file encoded in a scheme known as B-format from a sound source that is isotropically recorded. The sound field generated at the array of virtual loudspeakers can reproduce the effect of the sound source from any vantage point relative to the listener. Such decoding can be used in the delivery of audio through headphone speakers in Virtual Reality (VR) systems. Binaurally rendered high-order ambisonics (HOA) refers to the creation of many (e.g., at least 16) virtual loudspeakers which combine to provide a pair of signals to left and right headphone speakers. Frequently, such rendering takes into account the effect of a human auditory system using a set of Head Related Transfer Functions (HRTFs). Performing convolutions on signals from each loudspeaker with the set of HRFTs provides the listener with a faithful reproduction of the sound source.

SUMMARY

In one general aspect, a method can include receiving, by controlling circuitry of a sound rendering computer configured to render sound fields in ears of a listener, a sound field, the sound field having (i) a first component that is symmetric about a forward axis of a head of the listener and (ii) a second component that is antisymmetric about the forward axis. The method can also include producing an aggregate head-related transfer function (HRTF), the aggregate HRTF having (i) a first component that is symmetric about a forward axis of a head of the listener and (ii) a second component that is antisymmetric about the forward axis. The method can further include performing a first convolution operation on the first component of the sound field with the first component of the aggregate HRTF to produce an aggregate symmetric rendered sound field and performing a second convolution operation on the second component of the sound field with the second component of the aggregate HRTF to produce an aggregate antisymmetric rendered sound field. The method can further include producing, as a rendered sound field in a first ear of the listener, a sum of the aggregate symmetric rendered sound field and the aggregate antisymmetric rendered sound field and producing, as a rendered sound field in a second ear of the listener, a difference between the aggregate symmetric rendered sound field and the aggregate antisymmetric rendered sound field.

The details of one or more implementations are set forth in the accompanying drawings and the description below. Other features will be apparent from the description and drawings, and from the claims.

DETAILED DESCRIPTION

Figure 1:
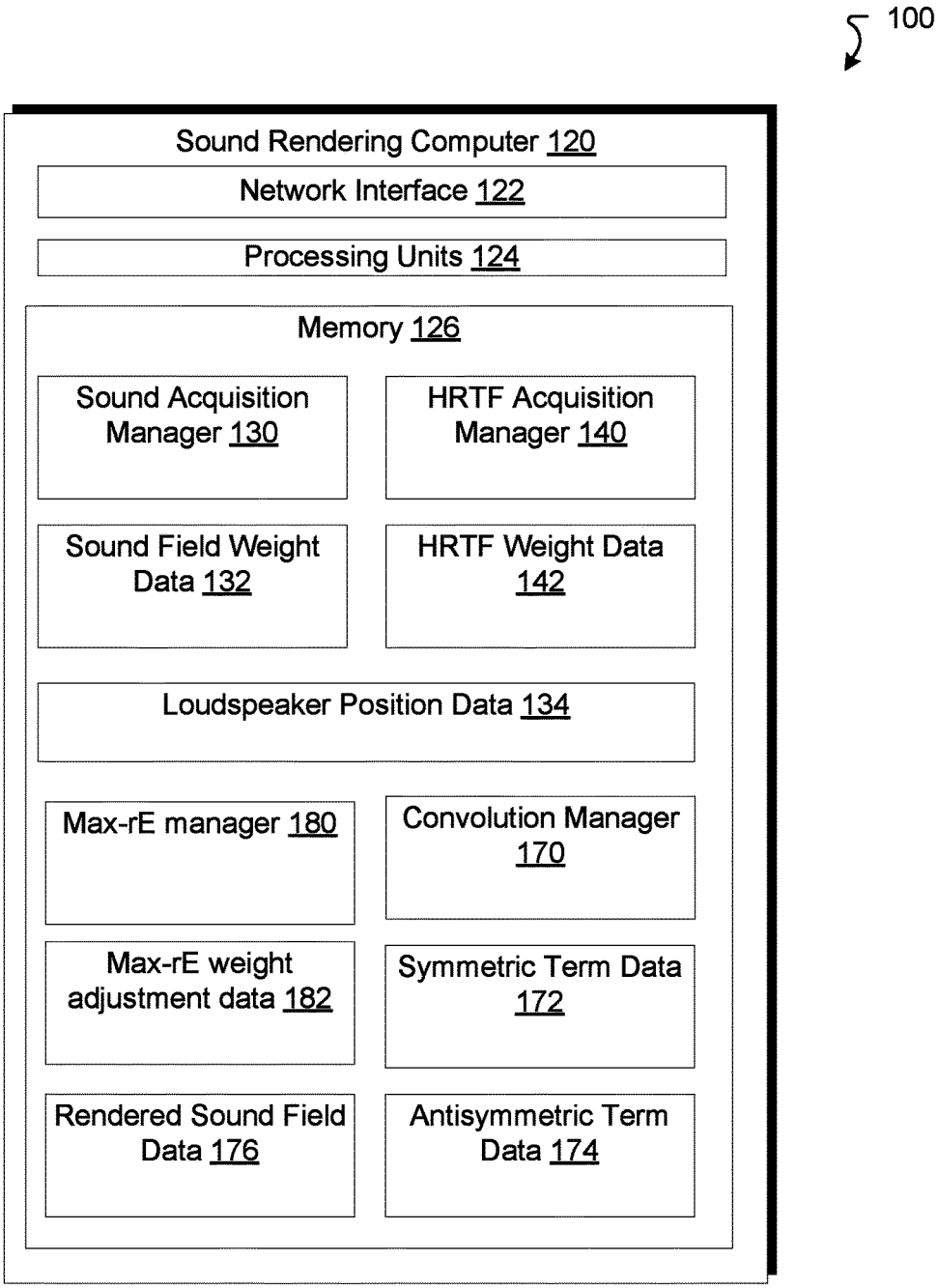
FIG. 1 is a diagram that illustrates an example electronic environment for implementing improved techniques described herein.

Conventional approaches to performing binaural rendering involve performing 2 convolutions per loudspeaker signal, i.e., a convolution of a HRTF with a decoded signal for that loudspeaker. Along these lines, in rendering third-order ambisonics, there are 16 loudspeakers to which a 16-channel B-format input is decoded. Taking the sample rate for VR audio to be 48 kHz and the size of a block on which convolutions are performed to be 1024, there are about 47 blocks per second that will be processed for each loudspeaker. Thus, there are 1024*2 signals per loudspeaker (left and right)*2 convolutions, which is 4096 operations per loudspeaker per block. This in turn amounts to 4096*16 loudspeakers*47 blocks=3,080,192 operations per second to render VR audio. It is desirable to reduce the computational burden in binaural rendering for VR systems without introducing losses or distortions in the rendered sound.

In accordance with the implementations described herein and in contrast with the above-described conventional approaches to performing binaural rendering, improved techniques involve separating symmetric and antisymmetric terms in the total output rendered in the ears of a listener. Along these lines, a sound field includes a set of sound field weights corresponding to spherical harmonic (SH) functions in a SH expansion of the sound field. In addition, an aggregate head-related transfer function (HRTF) includes a set of HRTF weights that correspond to a SH function. An HRTF weight may be generated from aggregating products of an HRTF at each of a set of loudspeaker positions and a SH function to which the HRTF weight corresponds at that loudspeaker position. The rendered sound field in one of the ears of the listener would be, when the sound field and HRTF is a function of frequency, a sum of the products of corresponding sound field weights and HRTF weights. One may save much computation by grouping the products into symmetric terms and antisymmetric terms. The rendered sound field in, say, the left ear is the sum over each loudspeaker position of the sum of the symmetric terms and antisymmetric terms for that loudspeaker position. Accordingly, because the head of the listener is assumed symmetric about the forward axis, the rendered sound field in the right ear is the sum over each loudspeaker position of the difference between the symmetric terms and antisymmetric terms for that loudspeaker position.

Advantageously, by taking advantage of the symmetry of the head as well as the inherent symmetries and antisymmetries of the spherical harmonics used to represent the decoded sound field and HRTF at each loudspeaker, the number of convolutions performed overall is reduced by a factor of two. This reduction in computation is accomplished without assuming anything about the loudspeaker positions and without introducing any loss mechanisms such as truncation. Further, the rendering may be achieved without performing a decoding step that requires generating a sound field from each of the loudspeaker positions.

FIG. 1 is a diagram that illustrates an example electronic environment 100 in which the above-described improved techniques may be implemented. As shown, in FIG. 1, the example electronic environment 100 includes a sound rendering computer 120.

The sound rendering computer 120 is configured to render sound fields in ears of a listener. The sound rendering computer 120 includes a network interface 122, one or more processing units 124, and memory 126. The network interface 122 includes, for example, Ethernet adaptors, Token Ring adaptors, and the like, for converting electronic and/or optical signals received from the network 170 to electronic form for use by the point cloud compression computer 120. The set of processing units 124 include one or more processing chips and/or assemblies. The memory 126 includes both volatile memory (e.g., RAM) and non-volatile memory, such as one or more ROMs, disk drives, solid state drives, and the like. The set of processing units 124 and the memory 126 together form control circuitry, which is configured and arranged to carry out various methods and functions as described herein.

In some embodiments, one or more of the components of the sound rendering computer 120 can be, or can include processors (e.g., processing units 124) configured to process instructions stored in the memory 126. Examples of such instructions as depicted in FIG. 1 include a sound acquisition manager 130, a HRTF acquisition manager 140, a convolution manager 170, and a max rE manager 180. Further, as illustrated in FIG. 1, the memory 126 is configured to store various data, which is described with respect to the respective managers that use such data.

The sound acquisition manager 130 is configured to acquire sound data 132 from various sources. For example, the sound acquisition manager 130 may the sound data 132 from an optical drive or over the network interface 122. Once it acquires the sound data 132, the sound acquisition manager is also configured to store the sound data 132 in memory 126. In some implementations, the sound acquisition manager 130 streams the sound data 132 over the network interface 122.

In some implementations, the sound data 132 is encoded in B-format, or first-order ambisonics with four components, or ambisonic channels. In other implementations, the sound data 132 is encoded in higher-order ambisonics, e.g., to order L. In this case, there will be $(L+1)^2$ ambisonic channels, each channel corresponding to a term in a spherical harmonic (SH) expansion of a sound field emanating from a loudspeaker.

The HRTF acquisition manager 140 is configured to acquire HRTF weight data 162. In some arrangements, the HRTF acquisition manager 140 produces the HRTF weight data 162 from HRTF data from each loudspeaker positioned about the listener according to loudspeaker position data 134. For example, the HRTF acquisition manager 140 may, for a SH function of a given order, sum, over the loudspeaker positions, the product of each HRTF at that loudspeaker position and the SH function evaluated at that loudspeaker position.

The convolution manager 170 is configured to perform convolutions on the sound field weight data 152 with the HRTF weight data 162 to produce rendered sound field data 176 sound fields in both left and right ears of the listener, i.e., rendered sound field data 176. The convolution manager 170 is also configured to split the result of the convolution of the sound field and the HRTF into symmetric term data 172 and antisymmetric term data 174. In this way, the rendered sound field data 176 is either a sum of the symmetric term data 172 and the antisymmetric term data 174, or a difference between the symmetric term data 172 and the antisymmetric term data 174.

The max rE manager 180 is configured to produce max rE weight adjustment data 182 for adjusting the sound field weight data 152 when a temporal frequency is above a temporal frequency threshold. Accordingly, prior to, during, or after convolution of the sound field with the HRTF, the max rE manager multiplies each term in the convolution series by a factor indicated by the max rE weight adjustment data 182. The max rE weight adjustment data 182 represents the different approach to optimizing sound field weights in the SH expansion of the sound field for high frequencies (in which the energy vector is optimized) than for low frequencies (in which pressure and a velocity vector is matched upon decoding).

In some implementations, the memory 126 can be any type of memory such as a random-access memory, a disk drive memory, flash memory, and/or so forth. In some implementations, the memory 126 can be implemented as more than one memory component (e.g., more than one RAM component or disk drive memory) associated with the components of the sound rendering computer 120. In some implementations, the memory 126 can be a database memory. In some implementations, the memory 126 can be, or can include, a non-local memory. For example, the memory 126 can be, or can include, a memory shared by multiple devices (not shown). In some implementations, the memory 126 can be associated with a server device (not shown) within a network and configured to serve the components of the sound rendering computer 120.

The components (e.g., modules, processing units 124) of the sound rendering computer 120 can be configured to operate based on one or more platforms (e.g., one or more similar or different platforms) that can include one or more types of hardware, software, firmware, operating systems, runtime libraries, and/or so forth. In some implementations, the components of the sound rendering computer 120 can be configured to operate within a cluster of devices (e.g., a server farm). In such an implementation, the functionality and processing of the components of the sound rendering computer 120 can be distributed to several devices of the cluster of devices.

The components of the sound rendering computer 120 can be, or can include, any type of hardware and/or software configured to process attributes. In some implementations, one or more portions of the components shown in the components of the sound rendering computer 120 in FIG. 1 can be, or can include, a hardware-based module (e.g., a digital signal processor (DSP), a field programmable gate array (FPGA), a memory), a firmware module, and/or a software-based module (e.g., a module of computer code, a set of computer-readable instructions that can be executed at a computer). For example, in some implementations, one or more portions of the components of the sound rendering computer 120 can be, or can include, a software module configured for execution by at least one processor (not shown). In some implementations, the functionality of the components can be included in different modules and/or different components than those shown in FIG. 1.

Although not shown, in some implementations, the components of the sound rendering computer 120 (or portions thereof) can be configured to operate within, for example, a data center (e.g., a cloud computing environment), a computer system, one or more server/host devices, and/or so forth. In some implementations, the components of the sound rendering computer 120 (or portions thereof) can be configured to operate within a network. Thus, the components of the sound rendering computer 120 (or portions thereof) can be configured to function within various types of network environments that can include one or more devices and/or one or more server devices. For example, the network can be, or can include, a local area network (LAN), a wide area network (WAN), and/or so forth. The network can be, or can include, a wireless network and/or wireless network implemented using, for example, gateway devices, bridges, switches, and/or so forth. The network can include one or more segments and/or can have portions based on various protocols such as Internet Protocol (IP) and/or a proprietary protocol. The network can include at least a portion of the Internet.

In some embodiments, one or more of the components of the sound rendering computer 120 can be, or can include, processors configured to process instructions stored in a memory. For example, the sound acquisition manager 130 (and/or a portion thereof), the HRTF acquisition manager 140 (and/or a portion thereof), the convolution manager 170 (and/or a portion thereof), and the max rE manager 180 (and/or a portion thereof) can be a combination of a processor and a memory configured to execute instructions related to a process to implement one or more functions.

Figure 2:
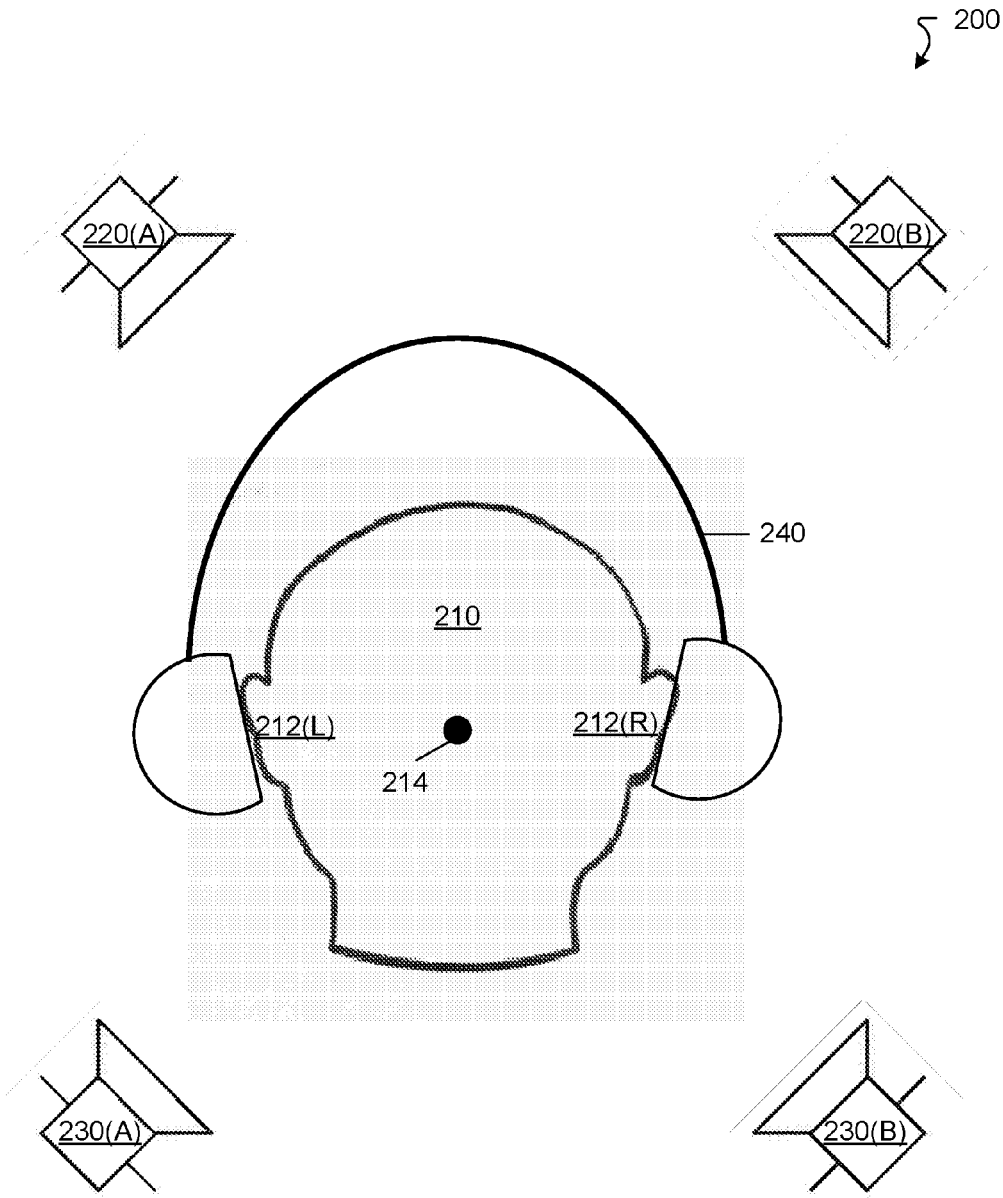
FIG. 2 is a diagram that illustrates an example sound field geometry according to the improved techniques described herein.

FIG. 2 illustrates an example sound field environment 200 according to the improved techniques. Within this environment 200, there is a listener whose head 210 has a left ear 212(L), a right ear 212(R), and a forward axis 214 (out of the paper). The listener is wearing a pair of headphones 240. Surrounding the listener are a first pair of loudspeakers 220(A) and 220(B) placed symmetrically with respect to the forward axis 214 and a second pair of loudspeakers placed symmetrically with respect to the forward axis 214. In some implementations, the loudspeakers 220(A,B) and 230(A,B) are virtual loudspeakers that represent locations with respect to the listener from which the listener perceives sound as the listener wears the headphones 240.

Consider the loudspeaker 220(A) through which the audio signal $w_{l^2+l+m}(f)$ is projected into each of N loudspeakers at the position $(\theta_k, \varphi_k)$. The frequency-space sound field $X_k$ emanating respectively from the loudspeaker 220(A) at the position $(\theta_k, \varphi_k)$ is given as an expansion in spherical harmonics:

$$X_k(\theta_k, \phi_k, f) = \sum_{l=0}^{L} \sum_{m=-l}^{l} w_{l^2+l+m}(f) Y_{lm}(\theta_k, \phi_k), \tag{1}$$

Note that $Y_{lm}(\theta_k, \varphi_k)$ represents the (l, m) real spherical harmonic as a function of elevation angle $\theta_k$ and azimuthal angle $\varphi_k$. The totality of the real spherical harmonics form an orthonormal basis set over the unit sphere. However, truncated representations over a finite number, $(L+1)^2$, of ambisonic channels are considered herein. Also, the weights $w_{l^2+l+m}(f)$ are functions of frequency f and represent the sound field weight data 152. In some implementations, the sound acquisition manager 130 (FIG. 1) acquires time-dependent weights and performs a Fourier transformation on, e.g., 1-second blocks of the weights to provide the frequency-space weights above.

It should be appreciated that the weights $w_{l^2+l+m}(f)$ are indexed in order according to the relation $p=l^2+l+m$. Conversely, a spherical harmonic order (l, m) may be determined from an ambisonic channel k according to $l=\lfloor\sqrt{p}\rfloor m=p-l(l+1)$. These relations provide a unique, one-to-one mapping between a spherical harmonic order (l, m) and an ambisonic channel p.

As discussed previously, binaural rendering of the sound fields $X_k(\theta_k, \varphi_k, f)$ in the left ear 212(L) and the right ear 212(R) is effected by performing a convolution operation on each of the sound fields with the respective left and right HRTFs of each of the loudspeakers. Note that a convolution operation over time is equivalent to a multiplication operation in frequency space. Accordingly, the sound fields in the left ear 212(L) L and right ear 212(R) R are as follows:

$$L(f) = \sum_{k=1}^{N} \sum_{l=0}^{L} \sum_{m=-l}^{l} [w_{l^2+l+m}(f) Y_{lm}(\theta_k, \phi_k)] H_L^{(k)}(f), \tag{2}$$

$$R(f) = \sum_{k=1}^{N} \sum_{l=0}^{L} \sum_{m=-l}^{l} [w_{l^2+l+m}(f) Y_{lm}(\theta_k, \phi_k)] H_R^{(k)}(f), \tag{3}$$

where N is the number of loudspeakers. The net rendered field in each ear is the sum of all of the convolutions over all of the loudspeakers.

The number of convolutions required to render the sound field in both ears is $2N(L+1)^2$. Nevertheless, by exploiting the fact that a human head is symmetric about the forward axis, the number of convolutions needed to render the sound field in both ears may be halved. This halving of the number of convolutions is independent of the loudspeaker positions about the sphere.

Specifically, the loudspeaker positions in principal do not need to conform to any symmetry. That said, the determination of the weights according to both a basic decoding scheme at low frequencies or a psychoacoustic decoding scheme at high frequencies is greatly simplified for regular layouts, e.g., when the loudspeaker positions are at the vertices of a platonic solid.

Reducing the computation involved in rendering the sound field involves expressing the HRTFs at each loudspeaker position in a SH expansion, similar to that for the sound field. Along these lines, define a set of frequency-dependent HRTF weights $h_{l^2+l+m}(f)$ as $$h_{l^2+l+m}(f) = \sum_{k=1}^{N} H_L^{(k)}(f) Y_{lm}(\theta_k, \phi_k). \tag{4}$$

Then, by changing the order of summation in Eq. (2), the net rendered field in the left ear may be expressed solely in terms of the sound field weights $w_{l^2+l+m}^{(k)}(f)$ and the HRTF weights $h_{l^2+l+m}^{(k)}(f)$ as follows:

$$L(f) = \sum_{l=0}^{L} \sum_{m=-l}^{l} w_{l^2+l+m}(f) h_{l^2+l+m}(f). \tag{5}$$

For example, when the audio is encoded in B-format, there are simply four terms as follows:

$$L(f)=w(W)h(W)+w(X)h(X)+w(Y)h(Y)+w(Z)H(Z). \quad (6)$$

The sought-after computational efficiency may be achieved by splitting the expression for the rendered sound field into symmetric and antisymmetric terms as follows:

$$L(f)=\sum_{l=0}^{L}\left[\sum_{m=0}^{l} w_{l^2+l+m}(f)h_{l^2+l+m}(f)+\sum_{m=1}^{l} w_{l^2+l-m}(f)h_{l^2+l-m}(f)\right]. \quad (7)$$

The first sum over m corresponds to symmetric terms with respect to the forward axis while the second sum over m corresponds to antisymmetric terms with respect to the forward axis. That is, the symmetric terms maintain their sign upon reflection about the forward axis, while the antisymmetric terms change their sign upon reflection about the forward axis.

When the rendered sound field in the left ear is split into such symmetric and antisymmetric terms, it has been found that the rendered sound field in the right ear may then be expressed as a similar expression:

$$R(f)=\sum_{l=0}^{L}\left[\sum_{m=0}^{l} w_{l^2+l+m}(f)h_{l^2+l+m}(f)-\sum_{m=1}^{l} w_{l^2+l-m}(f)h_{l^2+l-m}(f)\right]. \quad (8)$$

The efficiency provided by the improved techniques described above are now apparent from Eqs. (7) and (8): when the rendered sound field is generated in the left ear, the rendered sound field may also be generated in the right ear at no additional computational cost. This efficiency is achieved by the above-described grouping of the convolved weights into symmetric and antisymmetric terms. An additional benefit of using Eqs. (7) and (8) in generating the rendered sound fields is that the decoding step may be skipped.

The improved techniques described above also allow for zero-cost max rE sound field weight determination when the loudspeaker positions are in a regular layout such as a platonic solid. Along these lines, at high frequencies (e.g., above 700 Hz), the net normalized energy of signals, each emanating in the direction of each loudspeaker position is maximized. The maximization of this energy determines the sound field weights $w_{l^2+l+m}(f)$. It turns out that, for regular layouts of the loudspeaker positions, the sound field weights are proportional to sound field weights determined at low frequencies based on an equation of the pressure and velocities of the sound field to those generated by a sound source. The proportionality constants, or correction factors, may be stored in memory or determined from a table given the loudspeaker position data 134.

Figure 3:
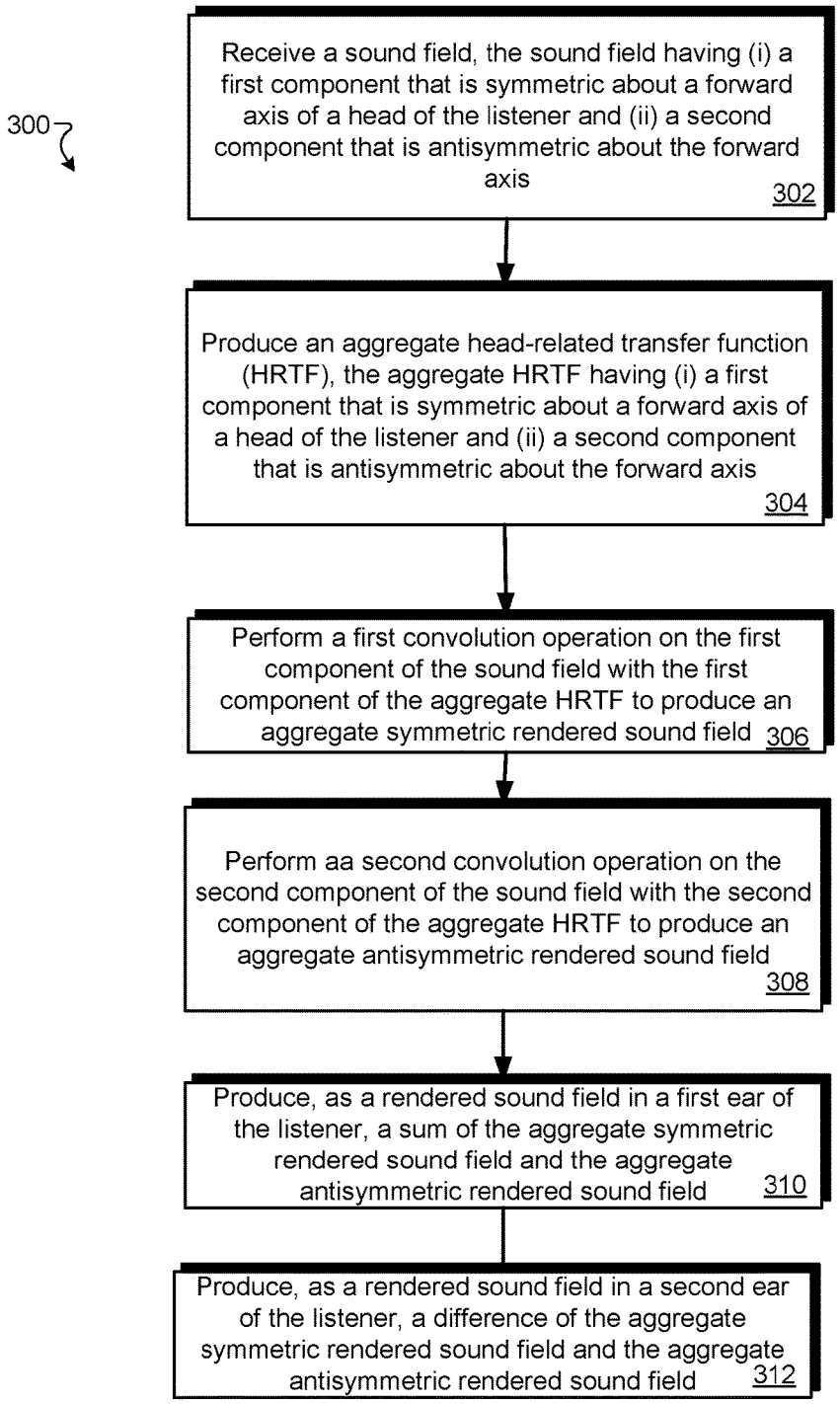
FIG. 3 is a flow chart that illustrates an example method of performing the improved techniques within the electronic environment shown in FIG. 1.

FIG. 3 is a flow chart that illustrates an example method 300 of performing binaural rendering of sound. The method 300 may be performed by software constructs described in connection with FIG. 1, which reside in memory 126 of the point cloud compression computer 120 and are run by the set of processing units 124.

At 302, controlling circuitry of a sound rendering computer configured to render sound fields in a left ear and a right ear of a head of a human listener receives a sound field. The sound field has (i) a first component that is symmetric about a forward axis of a head of the listener and (ii) a second component that is antisymmetric about the forward axis.

At 304, the controlling circuitry produces an aggregate head-related transfer function (HRTF). The aggregate HRTF has (i) a first component that is symmetric about a forward axis of a head of the listener and (ii) a second component that is antisymmetric about the forward axis.

At 306, the controlling circuitry performs a first convolution operation on the first component of the sound field with the first component of the aggregate HRTF to produce an aggregate symmetric rendered sound field.

At 308, the controlling circuitry a second convolution operation on the second component of the sound field with the second component of the aggregate HRTF to produce an aggregate antisymmetric rendered sound field.

At 310, the controlling circuitry produces, as a rendered sound field in a first ear of the listener, a sum of the aggregate symmetric rendered sound field and the aggregate antisymmetric rendered sound field.

At 312, the controlling circuitry produces, as a rendered sound field in a second ear of the listener, a difference between the aggregate symmetric rendered sound field and the aggregate antisymmetric rendered sound field.

Figure 4:
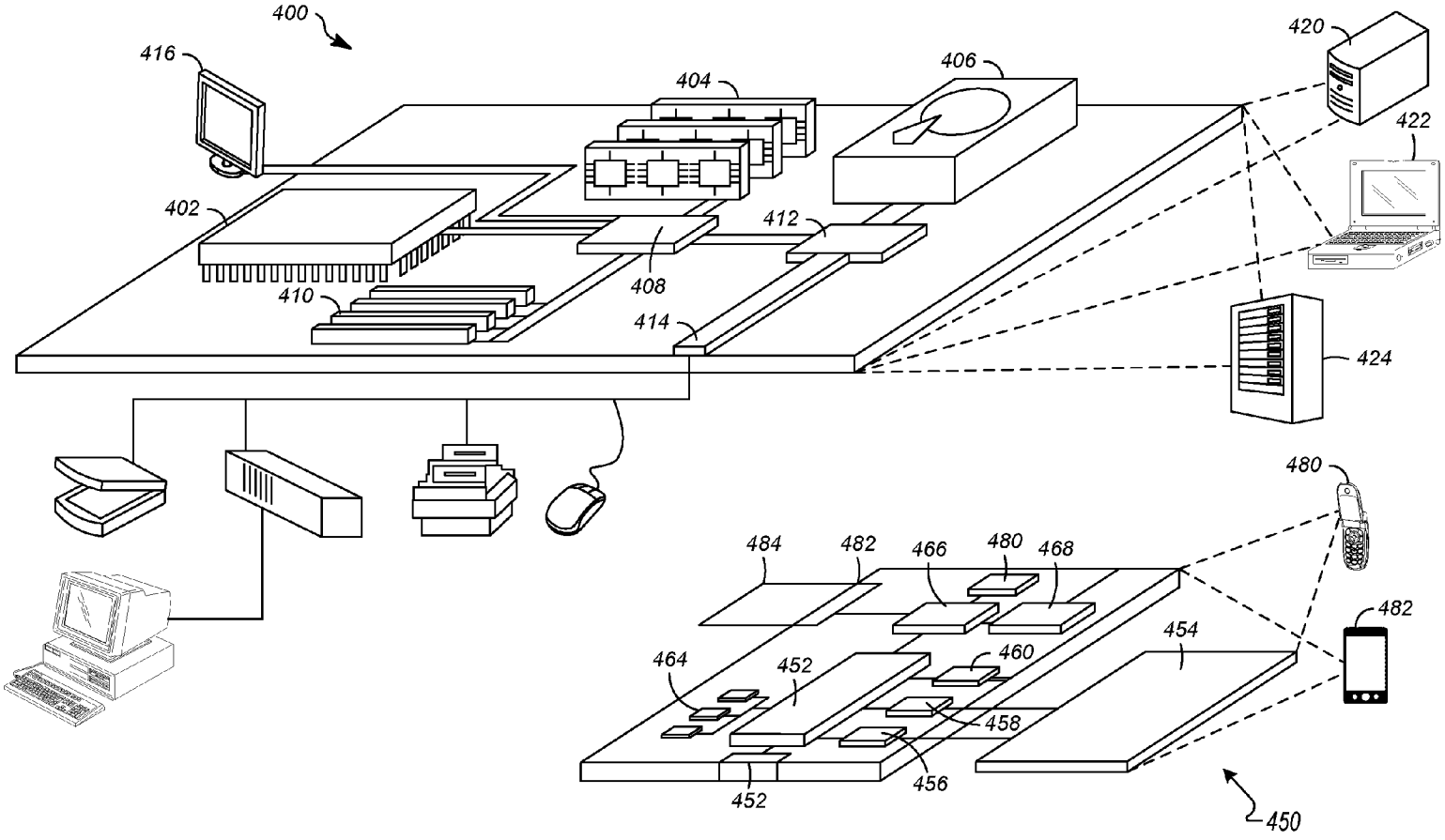
FIG. 4 illustrates an example of a computer device and a mobile computer device that can be used with circuits described here.

FIG. 4 illustrates an example of a generic computer device 400 and a generic mobile computer device 450, which may be used with the techniques described here.

As shown in FIG. 4, computing device 400 is intended to represent various forms of digital computers, such as laptops, desktops, workstations, personal digital assistants, servers, blade servers, mainframes, and other appropriate computers. Computing device 450 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 400 includes a processor 402, memory 404, a storage device 406, a high-speed interface 408 connecting to memory 404 and high-speed expansion ports 410, and a low speed interface 412 connecting to low speed bus 414 and storage device 406. Each of the components 402, 404, 406, 408, 410, and 412, are interconnected using various busses, and may be mounted on a common motherboard or in other manners as appropriate. The processor 402 can process instructions for execution within the computing device 400, including instructions stored in the memory 404 or on the storage device 406 to display graphical information for a GUI on an external input/output device, such as display 416 coupled to high speed interface 408. In other implementations, multiple processors and/or multiple buses may be used, as appropriate, along with multiple memories and types of memory. Also, multiple computing devices 400 may be connected, with each device providing portions of the necessary operations (e.g., as a server bank, a group of blade servers, or a multi-processor system).

The memory 404 stores information within the computing device 400. In one implementation, the memory 404 is a volatile memory unit or units. In another implementation, the memory 404 is a non-volatile memory unit or units. The memory 404 may also be another form of computer-readable medium, such as a magnetic or optical disk.

The storage device 406 is capable of providing mass storage for the computing device 400. In one implementation, the storage device 406 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 404, the storage device 406, or memory on processor 402.

The high speed controller 408 manages bandwidth-intensive operations for the computing device 400, while the low speed controller 412 manages lower bandwidth-intensive operations. Such allocation of functions is exemplary only. In one implementation, the high-speed controller 408 is coupled to memory 404, display 416 (e.g., through a graphics processor or accelerator), and to high-speed expansion ports 410, which may accept various expansion cards (not shown). In the implementation, low-speed controller 412 is coupled to storage device 406 and low-speed expansion port 414. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 400 may be implemented in a number of different forms, as shown in the figure. For example, it may be implemented as a standard server 420, or multiple times in a group of such servers. It may also be implemented as part of a rack server system 424. In addition, it may be implemented in a personal computer such as a laptop computer 422. Alternatively, components from computing device 400 may be combined with other components in a mobile device (not shown), such as device 450. Each of such devices may contain one or more of computing device 400, 450, and an entire system may be made up of multiple computing devices 400, 450 communicating with each other.

Computing device 450 includes a processor 452, memory 464, an input/output device such as a display 454, a communication interface 466, and a transceiver 468, among other components. The device 450 may also be provided with a storage device, such as a microdrive or other device, to provide additional storage. Each of the components 450, 452, 464, 454, 466, and 468, are interconnected using various buses, and several of the components may be mounted on a common motherboard or in other manners as appropriate.

The processor 452 can execute instructions within the computing device 450, including instructions stored in the memory 464. The processor may be implemented as a chipset of chips that include separate and multiple analog and digital processors. The processor may provide, for example, for coordination of the other components of the device 450, such as control of user interfaces, applications run by device 450, and wireless communication by device 450.

Processor 452 may communicate with a user through control interface 458 and display interface 456 coupled to a display 454. The display 454 may be, for example, a TFT LCD (Thin-Film-Transistor Liquid Crystal Display) or an OLED (Organic Light Emitting Diode) display, or other appropriate display technology. The display interface 456 may comprise appropriate circuitry for driving the display 454 to present graphical and other information to a user. The control interface 458 may receive commands from a user and convert them for submission to the processor 452. In addition, an external interface 462 may be provided in communication with processor 452, so as to enable near area communication of device 450 with other devices. External interface 462 may provide, for example, for wired communication in some implementations, or for wireless communication in other implementations, and multiple interfaces may also be used.

The memory 464 stores information within the computing device 450. The memory 464 can be implemented as one or more of a computer-readable medium or media, a volatile memory unit or units, or a non-volatile memory unit or units. Expansion memory 474 may also be provided and connected to device 450 through expansion interface 472, which may include, for example, a SIMM (Single In Line Memory Module) card interface. Such expansion memory 474 may provide extra storage space for device 450, or may also store applications or other information for device 450. Specifically, expansion memory 474 may include instructions to carry out or supplement the processes described above, and may include secure information also. Thus, for example, expansion memory 474 may be provided as a security module for device 450, and may be programmed with instructions that permit secure use of device 450. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 464, expansion memory 474, or memory on processor 452, that may be received, for example, over transceiver 468 or external interface 462.

Device 450 may communicate wirelessly through communication interface 466, which may include digital signal processing circuitry where necessary. Communication interface 466 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 468. In addition, short-range communication may occur, such as using a Bluetooth, WiFi, or other such transceiver (not shown). In addition, GPS (Global Positioning System) receiver module 470 may provide additional navigation- and location-related wireless data to device 450, which may be used as appropriate by applications running on device 450.

Device 450 may also communicate audibly using audio codec 460, which may receive spoken information from a user and convert it to usable digital information. Audio codec 460 may likewise generate audible sound for a user, such as through a speaker, e.g., in a handset of device 450. Such sound may include sound from voice telephone calls, may include recorded sound (e.g., voice messages, music files, etc.) and may also include sound generated by applications operating on device 450.

The computing device 450 may be implemented in a number of different forms, as shown in the figure. For example, it may be implemented as a cellular telephone 480.

It may also be implemented as part of a smart phone 482, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

A number of embodiments have been described. Nevertheless, it will be understood that various modifications may be made without departing from the spirit and scope of the specification.

It will also be understood that when an element is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element, there are no intervening elements present. Although the terms directly on, directly connected to, or directly coupled to may not be used throughout the detailed description, elements that are shown as being directly on, directly connected or directly coupled can be referred to as such. The claims of the application may be amended to recite exemplary relationships described in the specification or shown in the figures.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

What is claimed is:

1. A method, comprising:

receiving, by controlling circuitry of a sound rendering computer configured to render sound fields in ears of a listener, a sound field, the sound field having (i) a first component that is symmetric about a forward axis of a head of the listener and (ii) a second component that is antisymmetric about the forward axis;

producing an aggregate head-related transfer function (HRTF), the aggregate HRTF having (i) a first component that is symmetric about a forward axis of a head of the listener and (ii) a second component that is antisymmetric about the forward axis;

performing a first convolution operation on the first component of the sound field with the first component of the aggregate HRTF to produce an aggregate symmetric rendered sound field;

performing a second convolution operation on the second component of the sound field with the second component of the aggregate HRTF to produce an aggregate antisymmetric rendered sound field;

producing, as a rendered sound field in a first ear of the listener, a sum of the aggregate symmetric rendered sound field and the aggregate antisymmetric rendered sound field; and producing, as a rendered sound field in a second ear of the listener, a difference between the aggregate symmetric rendered sound field and the aggregate antisymmetric rendered sound field.

2. The method as in claim 1, wherein the sound field includes a set of sound field weights, each of the set of sound field weights corresponding to a spherical harmonic (SH) function in a SH expansion of the sound field;

wherein the aggregate HRTF includes a set of HRTF weights, each of the set of HRTF weights corresponding to a SH function in the SH expansion of the sound field; and wherein producing the aggregate HRTF includes:

for each of a set of loudspeaker positions on a sphere centered on the listener, acquiring a head-related transfer function (HRTF) corresponding to that loudspeaker position; and generating, as an HRTF weight of the set of HRTF weights corresponding to a SH function in the SH expansion, a sum over the set of loudspeaker positions of a product of the SH function evaluated at that loudspeaker position and the HRTF at that loudspeaker position.

3. The method as in claim 2, wherein the SH expansion of the sound field has a specified order L and includes a sum over $(L+1)^2$ terms, each of the $(L+1)^2$ terms being a product of a SH function of order (l, m), $0 \le l \le L$, $-l \le m \le l$, and a corresponding sound field weight;

wherein the method further comprises:

producing, as a symmetric term of the SH expansion of the sound field, a sound field weight of the set of sound field weights corresponding to the spherical harmonic function of order (l, m), where $m \ge 0$; and producing, as an antisymmetric term of the SH expansion of the sound field, another sound field weight of the set of sound field weights corresponding to the spherical harmonic function of order (l, m) evaluated at that loudspeaker position, where $m<0$.

4. The method as in claim 3, wherein performing the first convolution operation on the first component of the sound field with the first component of the aggregate HRTF includes summing, for each $0 \le l \le L$ and $0 \le m \le l$, products of (i) the sound field weight corresponding to the SH function of order (l, m) and (ii) the HRTF weight corresponding to the SH function of order (l, m) to form the aggregate symmetric rendered sound field, and wherein performing the second convolution operation on the second component of the sound field with the second component of the aggregate HRTF includes summing, for each $0 \le l \le L$ and $-l \le m \le -1$, products of (i) the sound field weight corresponding to the SH function of order (l, m) and (ii) the HRTF weight corresponding to the SH function of order (l, m) to form the aggregate antisymmetric rendered sound field.

5. The method as in claim 3, wherein there are at least $(L+1)^2$ loudspeaker positions in the set of loudspeaker positions.

6. The method as in claim 3, wherein each respective sound field weight and each respective HRTF weight corresponding to the SH function of order (l, m), $0 \le l \le L$, $-l \le m \le l$, is a function of a temporal frequency, and wherein the method further comprises, in response to the temporal frequency being greater than a specified threshold frequency and prior to performing the first convolution operation and the second convolution operation, multiplying each respective sound field weight by a specified correction factor.

7. The method as in claim 2, wherein the set of loudspeaker positions include vertices of a platonic solid.

8. A computer program product comprising a nontransitive storage medium, the computer program product including code that, when executed by processing circuitry of a sound rendering computer configured to render sound fields in ears of a listener, causes the processing circuitry to perform a method, the method comprising:

receiving a sound field, the sound field having (i) a first component that is symmetric about a forward axis of a head of the listener and (ii) a second component that is antisymmetric about the forward axis;

producing an aggregate head-related transfer function (HRTF), the aggregate HRTF having (i) a first component that is symmetric about a forward axis of a head of the listener and (ii) a second component that is antisymmetric about the forward axis;

performing a first convolution operation on the first component of the sound field with the first component of the aggregate HRTF to produce an aggregate symmetric rendered sound field;

performing a second convolution operation on the second component of the sound field with the second component of the aggregate HRTF to produce an aggregate antisymmetric rendered sound field;

producing, as a rendered sound field in a first ear of the listener, a sum of the aggregate symmetric rendered sound field and the aggregate antisymmetric rendered sound field; and producing, as a rendered sound field in a second ear of the listener, a difference between the aggregate symmetric rendered sound field and the aggregate antisymmetric rendered sound field.

9. The computer program product as in claim 8, wherein the sound field includes a set of sound field weights, each of the set of sound field weights corresponding to a spherical harmonic (SH) function in a SH expansion of the sound field;

wherein the aggregate HRTF includes a set of HRTF weights, each of the set of HRTF weights corresponding to a SH function in the SH expansion of the sound field; and wherein producing the aggregate HRTF includes:

for each of a set of loudspeaker positions on a sphere centered on the listener, acquiring a head-related transfer function (HRTF) corresponding to that loudspeaker position; and generating, as an HRTF weight of the set of HRTF weights corresponding to a SH function in the SH expansion, a sum over the set of loudspeaker positions of a product of the SH function evaluated at that loudspeaker position and the HRTF at that loudspeaker position.

10. The computer program product as in claim 9, wherein the SH expansion of the sound field has a specified order L and includes a sum over $(L+1)^2$ terms, each of the $(L+1)^2$ terms being a product of a SH function of order (l, m), $0 \le l \le L$, $-l \le m \le l$, and a corresponding sound field weight;

wherein the method further comprises:

producing, as a symmetric term of the SH expansion of the sound field, a sound field weight of the set of sound field weights corresponding to the spherical harmonic function of order (l, m), where $m \ge 0$; and producing, as an antisymmetric term of the SH expansion of the sound field, another sound field weight of the set of sound field weights corresponding to the spherical harmonic function of order (l, m) evaluated at that loudspeaker position, where $m<0$.

11. The computer program product as in claim 10, wherein performing the first convolution operation on the first component of the sound field with the first component of the aggregate HRTF includes summing, for each $0 \le l \le L$ and $0 \le m \le l$, products of (i) the sound field weight corresponding to the SH function of order (l, m) and (ii) the HRTF weight corresponding to the SH function of order (l, m) to form the aggregate symmetric rendered sound field, and wherein performing the second convolution operation on the second component of the sound field produced with the second component of the aggregate HRTF includes summing, for each $0 \le l \le L$ and $-l \le m \le -1$, products of (i) the sound field weight corresponding to the SH function of order (l, m) and (ii) the HRTF weight corresponding to the SH function of order (l, m) to form the aggregate antisymmetric rendered sound field.

12. The computer program product as in claim 10, wherein there are at least $(L+1)^2$ loudspeaker positions in the set of loudspeaker positions.

13. The computer program product as in claim 10, wherein each respective sound field weight and each respective HRTF weight corresponding to the SH function of order (l, m), $0 \le l \le L$, $-l \le m \le l$, is a function of a temporal frequency, and wherein the method further comprises, in response to the temporal frequency being greater than a specified threshold frequency and prior to performing the first convolution operation and the second convolution operation, multiplying each respective sound field weight by a specified correction factor.

14. The computer program product as in claim 9, wherein the set of loudspeaker positions include vertices of a platonic solid.

15. An electronic apparatus configured to render sound fields in ears of a listener, the electronic apparatus comprising:

memory; and controlling circuitry coupled to the memory, the controlling circuitry being configured to:

receive a sound field, the sound field having (i) a first component that is symmetric about a forward axis of a head of the listener and (ii) a second component that is antisymmetric about the forward axis;

produce an aggregate head-related transfer function (HRTF), the aggregate HRTF having (i) a first component that is symmetric about a forward axis of a head of the listener and (ii) a second component that is antisymmetric about the forward axis;

perform a first convolution operation on the first component of the sound field with the first component of the aggregate HRTF to produce an aggregate symmetric rendered sound field;

perform a second convolution operation on the second component of the sound field with the second component of the aggregate HRTF to produce an aggregate antisymmetric rendered sound field;

produce, as a rendered sound field in a first ear of the listener, a sum of the aggregate symmetric rendered sound field and the aggregate antisymmetric rendered sound field; and produce, as a rendered sound field in a second ear of the listener, a difference between the aggregate symmetric rendered sound field and the aggregate antisymmetric rendered sound field.

16. The electronic apparatus as in claim 15, wherein the sound field includes a set of sound field weights, each of the set of sound field weights corresponding to a spherical harmonic (SH) function in a SH expansion of the sound field;

wherein the aggregate HRTF includes a set of HRTF weights, each of the set of HRTF weights corresponding to a SH function in the SH expansion of the sound field; and wherein the controlling circuitry configured to produce the aggregate HRTF is further configured to:

for each of a set of loudspeaker positions on a sphere centered on the listener, acquire a head-related transfer function (HRTF) corresponding to that loudspeaker position; and generate, as an HRTF weight of the set of HRTF weights corresponding to a SH function in the SH expansion, a sum over the set of loudspeaker positions of a product of the SH function evaluated at that loudspeaker position and the HRTF at that loudspeaker position.

17. The electronic apparatus as in claim 16, wherein the SH expansion of the sound field has a specified order L and includes a sum over $(L+1)^2$ terms, each of the $(L+1)^2$ terms being a product of a SH function of order (l, m), $0 \le l \le L$, $-l \le m \le l$, and a corresponding sound field weight;

wherein the controlling circuitry is further configured to:

produce, as a symmetric term of the SH expansion of the sound field, a sound field weight of the set of sound field weights corresponding to the spherical harmonic function of order (l, m), where $m \ge 0$; and produce, as an antisymmetric term of the SH expansion of the sound field, another sound field weight of the set of sound field weights corresponding to the spherical harmonic function of order (l, m) evaluated at that loudspeaker position, where $m<0$.

18. The electronic apparatus as in claim 17, wherein the controlling circuitry configured to perform the first convolution operation on the first component of the sound field with the first component of the aggregate HRTF is further configured to sum, for each $0 \le l \le L$ and $0 \le m \le l$, products of (i) the sound field weight corresponding to the SH function of order (l, m) and (ii) the HRTF weight corresponding to the SH function of order (l, m), and wherein the controlling circuitry configured to perform the second convolution operation on the second component of the sound field produced with the second component of the aggregate HRTF is further configured to sum, for each $0 \le l \le L$ and $-l \le m \le -1$, products of (i) the sound field weight corresponding to the SH function of order (l, m) and (ii) the HRTF weight corresponding to the SH function of order (l, m).

19. The electronic apparatus as in claim 17, wherein there are at least $(L+1)^2$ loudspeaker positions in the set of loudspeaker positions.

20. The electronic apparatus as in claim 17, wherein each respective sound field weight and each respective HRTF weight corresponding to the SH function of order (l, m), $0 \le l \le L$, $-l \le m \le l$, is a function of a temporal frequency, and wherein the controlling circuitry is further configured to, in response to the temporal frequency being greater than a specified threshold frequency and prior to performing the first convolution operation and the second convolution operation, multiply each respective sound field weight by a specified correction factor.

* * * * *